United States Patent [19]

Beck

[11] 4,426,745

[45] Jan. 24, 1984

[54] ABLUTIONARY SHOWER SYSTEMS

[75] Inventor: Nicholas J. Beck, Tewkesbury, England

[73] Assignee: Walker Crosweller & Company Ltd., Gloucestershire, England

[21] Appl. No.: 380,396

[22] Filed: May 20, 1982

[30] Foreign Application Priority Data

Jun. 13, 1981 [GB] United Kingdom ..... 8118272

[51] Int. Cl.[3] ..... A47K 3/22; A47K 3/23

[52] U.S. Cl. ..... 4/597; 4/596; 4/605; 4/612; 128/366

[58] Field of Search ..... 4/596, 597, 605, 612, 4/615, 616, 624; 128/366

[56] References Cited

U.S. PATENT DOCUMENTS 2,478,348 8/1949 Wicker et al. ..... 4/597

FOREIGN PATENT DOCUMENTS 2911937 10/1980 Fed. Rep. of Germany ..... 4/596

*Primary Examiner*—Henry K. Artis

*Attorney, Agent, or Firm*—Larson and Taylor

[57] ABSTRACT

An automatic drain-off valve for an ablutionary shower system is provided at the lowest point of the supply pipe at or from the shower control or mixing valve to the shower spray head. The drain valve (30) comprises a body (1) having a chamber (7) in which a clack valve (3) is mounted and which is normally biassed into the open position relative to a port (16) surrounded by a seating (8). The port (16) comprises a series of through bores opening to the bottom of the valve for discharging water from the chamber (7) to waste. When water flows through the supply pipe of the shower system, the chamber (7) fills and pressure on the clack valve overcomes the bias applied to the valve spindle (4) by a spring (14) so that the valve close on the seating (8). A clearance gap (9) is provided between the periphery of the clack valve and the internal wall of the chamber (7) to ensure that when the valve is open water can drain through the valve, but the gap is small and restricts flow when the chamber (7) is filled and cause pressure build-up in the chamber (7) to close the valve. In a modification, the spring bias is adjustable. Automatic drain-off in shower systems is considered as a preventative measure with regard to Legionnaire's disease as well as for other advantages avoiding stagnation of water in the shower head supply pipe. Various installations are described.

8 Claims, 8 Drawing Figures

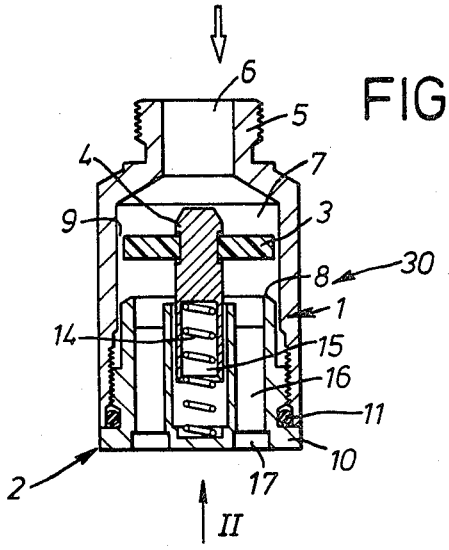
FIG.1
FIG.2
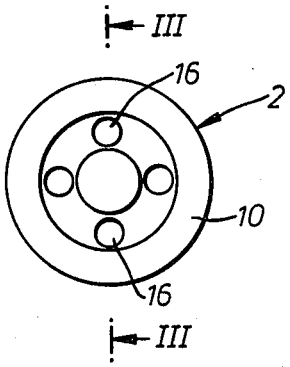
FIG.3
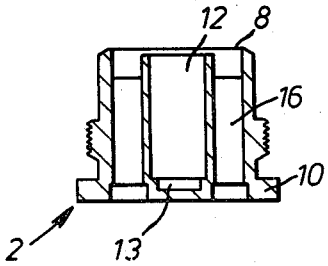

ABLUTIONARY SHOWER SYSTEMS

BACKGROUND OF THE INVENTION

This invention relates to improvements in shower systems for ablutionary use.

In the majority of shower systems, there is an outlet with the spray head which is remote from the control or mixing valve which, in some installations, can be incorporated in the heater. The supply pipe extending from the control valve to the spray head provides a "dead leg" in which water will remain between successive use of the shower. The supply pipe may be fixed or flexible depending on the shower system.

For several reasons this stagnation of a volume of water is the supply pipe is undesirable. One reason coming into recent dominance is the finding that the bacteria called Legionella Pneumophila is commonly found in water supplies and thrives at temperatures of about 35° C. The disease called Legionnaire's disease is found to be contracted by the inhalation of water droplets or moist air containing the bacteria. Accordingly, it is supposed that sources of infection could arise from shower outlets where conditions in the stagnant volume in the supply pipe are favourable to be rapid increase of the bacteria.

SUMMARY OF THE INVENTION

According to this invention we provide in a shower system for ablutionary use, a drain valve fitted to the lowest point of the water supply pipe leading to the shower head, the drain valve comprising a hollow body mounting a clack valve for movement in a chamber relative to a valve seat of a port leading to a drain outlet, the chamber is in communication with the interior of said supply pipe and the clack valve is biased away from the valve seat to be disposed in the chamber and subject to flow pressures in said supply pipe whereby the clack valve is closed onto the valve seat on flow of water through said supply pipe, and on cessation or very low flow rates the clack valve automatically opens lifting from the valve seat to open the port and permit water in the chamber and said supply pipe to drain past the clack valve to the drain outlet.

By this provision of a drain valve which functions automatically in response to flow rates through the supply pipe leading to the shower head, any water which would otherwise remain in this pipe and spray head is drained off on cessation of a shower, or prevents water collecting therein, for instance if the control or mixing valve were not completely turned off or seepage occurred.

In an ablutionary shower installation, the drain valve outlet may be disposed over the ablutionary catchment such as the shower base or bath to run to waste. The valve body may be designed to direct the discharge in a suitable direction if required.

Preferably, the drain valve includes a spring acting on the clack valve, and the pressure applied by the spring to the clack valve is adjustable.

By providing such adjustment, the drain valve can be set to accommodate and to operate at the particular flow pressure of the specific shower installation. Furthermore, the same design and rating of drain valve can be employed in range of different shower installations.

Preferably, the valve body is provided at one end remote from the drain outlet with a threaded hollow boss for connecting the drain valve to said supply pipe through a T-connector. The two opposed connections of the T-connector may be respectively coupled in the flow path between the control or mixing valve and the supply pipe at the lowest suitable position.

By such an arrangement, the drain valve can easily be fitted to existing shower installations, or existing designs may be modified.

The valve body conveniently may comprise a substantially cylindrical body having the connection to said supply pipe at one end with the clack valve being mounted for axial movement on a spindle supported concentric to the seating disposed within the valve body intermediate the boss and the drain outlet.

The chamber within the valve body and defined thereby is cylindrical. The clack valve is of annular form mounted on the head of the spindle. The seating is annular for engagement with the clack valve and the outlet port extends between the spindle and the seating.

There is a limited annular clearance between the clack valve and the wall of the chamber so that a seepage or drainage path is provided through the chamber past the clack valve when the valve is in the open position, but the clearance is limited so that on flow of water into the chamber, outflow is restricted to cause an increase in pressure which overcomes the bias force applied to the valve thereby to cause the clack valve to close on the seating.

This arrangement and mode of operation is simple and provides the automatic drainage of the supply line to the shower head avoiding any need for the user to take any action. Furthermore, no modification to the actual control or mixing valve is required.

Preferably, the seating, the outlet port and the support for the spindle are provided by a seat member which is located within the end of the valve body remote from the boss. The seat member comprises a substantially cylindrical body in sealed and threaded engagement with the valve body.

The seat member has an annular end face defining the valve seating, and a plurality of axial bores extending radially inwards of the seating and through the seat member to define the outlet port. Centrally of the seat member there is a closed end bore in which the valve spindle is supported and a spring acts between the valve spindle and the seat member. The spring may comprise a helical spring having one end located within the closed bore and extending into a closed bore within the valve spindle.

Conveniently, the closed bore in the seat member both guides and locates the valve spindle for the axial movement as well as providing a housing for the spring.

The seat member is preferably arranged for simple assembly to or from the valve body to facilitate cleaning, inspection or servicing as may be required.

DESCRIPTION OF THE DRAWINGS

Exemplary embodiments of ablutionary shower systems including drain valves according to this invention will now be described with reference to the accompanying drawing wherein:

FIG. 1 is a longitudinal section of an exemplary drain valve;

FIG. 2 is a view of the seat member in the direction indicated at II in FIG. 1;

FIG. 3 is a sectional view of the seat member in the planes indicated at III—III in FIG. 2;

DETAILED DESCRIPTION OF THE EMBODIMENTS

Figure 4:
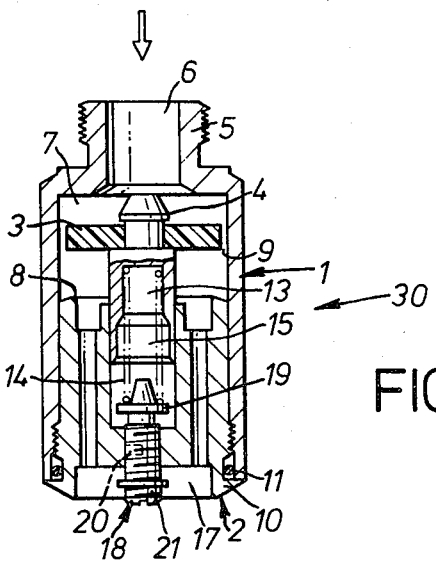
FIG. 4 is a longitudinal section of another exemplary drain valve similar to that depicted in FIGS. 1, 2 and 3.

With reference to the drawings of FIGS. 1, 2 and 3, the examplary drain valve comprises a valve body 1, a seat member 2, a clack valve 3 carried on a spindle 4 mounted in the seat member 2. The valve body 1 has a threaded hollow boss 5 at one end for connection to a supply pipe (not shown) connected to a shower head to provide an entry 6 for water in said supply pipe.

The body 1 provides a chamber 7 of generally cylindrical shape in which the clack valve 3 is arranged to move from the open position shown in FIG. 1 to a closed position engaging an annular end face 8 of the seat member 2 which constitutes a seating for the clack valve 3. There is a small annular clearance 9 between the peripheral edge of the clack valve 3 and the internal wall of the chamber 7. The clack valve 3 is an annular disc or washer mounted on the head of the spindle 4 in a groove in the spindle.

The seating member 2 is received within one end of the valve body 1 and is on threaded engagement therewith. The seat member has an end flange 10 which provides an inward abutment for engaging an O-ring seal 11 disposed between the seat member and the valve body.

The seat member 2 has a central axially extending closed bore 12 and a small counterbore 13 is provided in the bottom of the bore to locate one end of a helical spring 14. In the bore 12 the valve spindle is received for sliding movement, and the end of the valve spindle has a closed bore 15 in which the other end of the spring 14 is received. Accordingly, the clack valve 3 is biassed by the spring 14 into the open position shown.

The seat member 2 is provided with four through bores 16 which at one end open through the bottom of the seat member to provide a drain outlet 17 and which at the other end constitute a port adjacent the seat 8 for closure by the clack valve 3.

The port may be constituted by a single annular opening with the spindle being supported by a sleeve or tube-like member forming a hub having radial webs of spokes connected to an outer sleeve-like part of the seat member.

The valve body 1 and the seat member 2 may be castings of brass or other suitable material, the spindle is also preferably of brass, and the clack valve is of rubber or other elastomeric or plastics material. The valve body and the seat member may be plated on external surfaces.

With reference to the drawing of FIG. 4 this shows a modified form of drain valve similar to that just described and the same references are used to indicate like parts. In this modified form, the drain valve includes means by which the pressure at which the valve operates in an installation can be varied to suit the pressure conditions prevailing in an installation.

The valve body 1 receives the seating member 2 and the clack valve 3 is mounted on the spindle 4 and one end of the spring 14 is received in the small bore 13. The adjuster comprises a screw-threaded stud 18 extending through a threaded bore in the seating member 2 opening to the bore 15, and the other end of the spring 14 is located on a flanged domed end 19 of the stud 18. The stud 18 is arranged to be self-locking by a transverse plastic plug 20 which is seated in a recess in the threaded shank of the stud 18 and which frictionally engages with the internal thread. The head 21 of the stud 18 projects from the end face of the seating member 2 and has a cross slot enabling the stud to be rotated by a suitable driver.

On rotating the stud 18, the pressure bias applied to the clack valve 3 through the spring 14 may be adjusted to reduce or increase the bias to suit the water pressure at the inlet 6 in use of the drain valve in an installation as later described.

The drain valve is installed in an ablutionary shower system so as to be at the lowest position of the water supply line to the shower spray head. Various arrangements are suitable and exemplary installations are shown schematically in FIGS. 6, 7 and 8 to which reference is now made.

Figure 5:
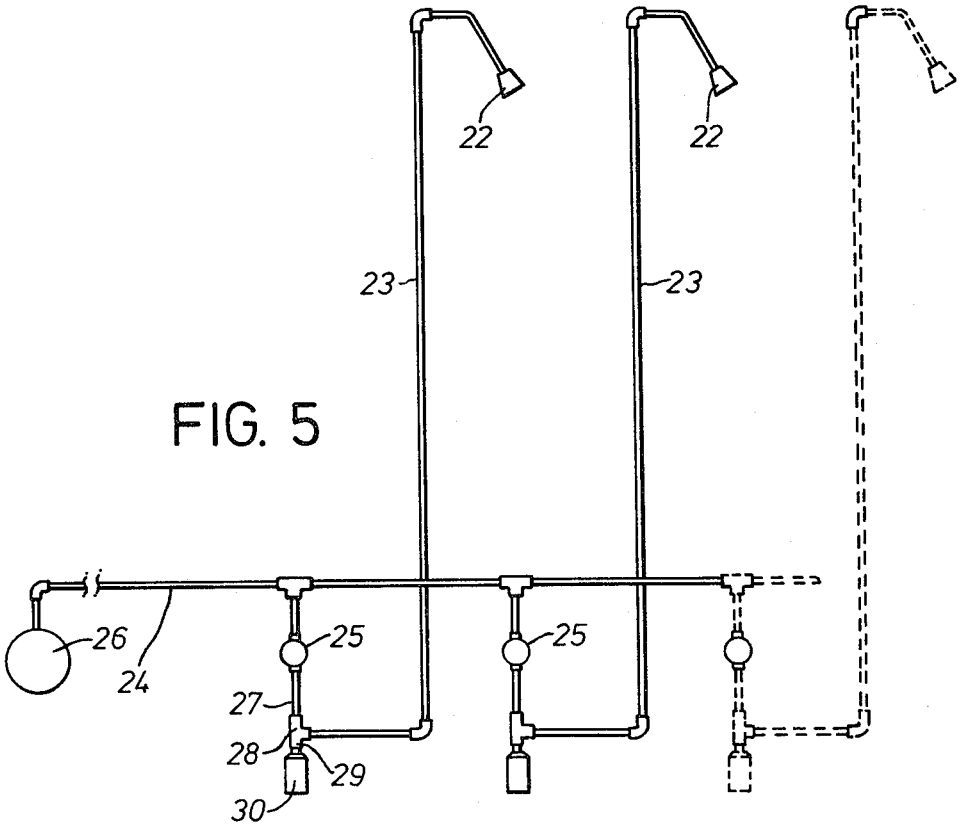
FIGS. 5, 6, 7 and 8 are schematic views of different ablutionary shower systems according to this invention.

The installation depicted in FIG. 5 is typical of a multiple shower arrangement such as used in an institution, school, hospital or similar. In such installation each of the several shower spray heads 22 are connected to a respective fixed rising supply pipe 23 with the supply of blended hot/cold water from a comon supply pipe 24 being controlled by a respective suitable stopcock 25. The temperature of the blended water in the common supply pipe 24 is controlled remotely from the shower spray heads by a suitable mixing or control valve 26.

In the installation for each shower spray head the pipe 27 leading from the respective stopcock 25 is arranged to fall to a low point where a T-connection 28 is provided for connection to the rising supply pipe 23. The lowest arm 29 of the T-connection is coupled to the inlet 6 of a drain valve 30 as aforedescribed. The drain outlet of the valve 30 opens downwardly to drain off any water remaining in the pipe 27, the rising supply pipe 23 and shower head 22 after use.

Figure 6:
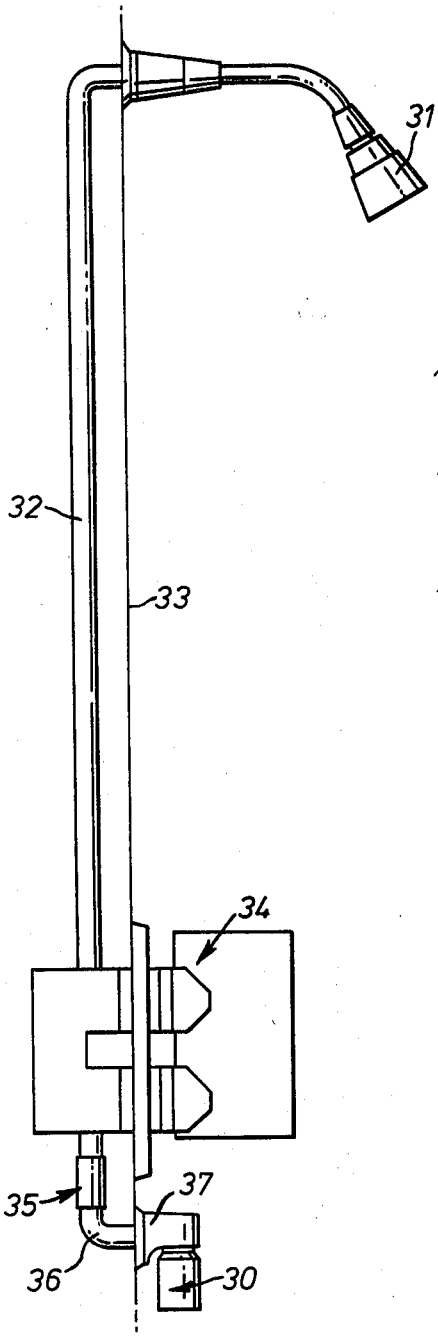

Another ablutionary shower arrangement is depicted in FIG. 6 wherein the shower spray head 31 is fixed with a rising supply pipe 32 being located behind a facia or screen 33. A water mixing and control valve 34 connected to hot and cold supplies is surface mounted to the facia 33 for operation by the user. The rising supply pipe 32 is extended below the level of the valve 34 and has a T-connector 35 through one limb of which blended water from the valve 34 is supplied to the rising supply pipe 32. Through the other limb of the T-connector 35 water may be drained down to a dependent elbow pipe 36 which is connected by a coupling 37 to the inlet of a drain valve 30 on the facia 33 below the mixing valve. The drain outlet of the valve 30 will be disposed for discharge into the shower tray or bath (not shown).

Figure 7:
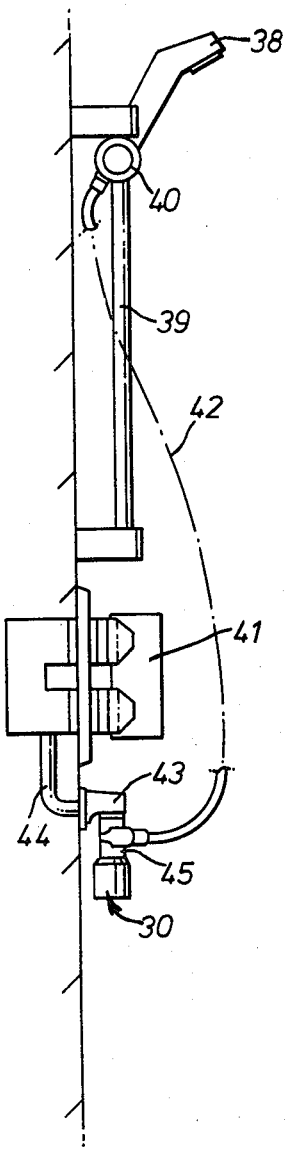
Figure 8:
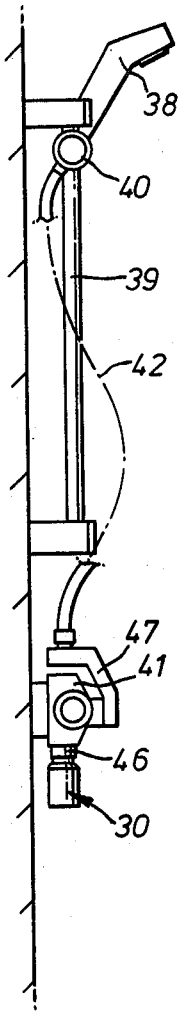

The ablutionary shower installations shown in FIGS. 7 and 8 are of similar principle as just described with reference to FIG. 6 and will be described only briefly.

In each installation, the shower spray head 38 is mounted on a slide rail 39 by a slidable bracket 40 by which the height and attitude of the head 38 may be varied above the location of the associated water mixing and control valve 41. In each arrangement the head 38 is connected to the respective valve by a flexible pipe 42 of which the overall length is limited to prevent looping or coiling below the lowest point through which mixed water is supplied.

In the arrangement of the installation depicted in FIG. 8, there is a gland 43 connected to the outlet pipe 44 from the valve 41. The gland 43 is coupled to one limb of a T-connector 45 to which one other limb is connected to the flexible pipe 42. The lower limb of the T-connector 45 is connected to a drain valve 30.

In the arrangement of the installation depicted in FIG. 9, the drain valve 30 is connected directly to an outlet 46 provided in the mixing and control valve 41 from which the supply outlet 47 to the shower head 38 rises separately at a level above the drain valve 30.

Following the description of several exemplary installations including the drain valve, the operation and function of the drain valve in use will be described.

The drain valve 30 is normally in the open position as shown in FIGS. 1 and 5 when there is no flow or only seepage of water into the chamber 7. The clack valve 3 is maintained open by the bias of spring 14. When this condition prevails, any water above the level of the drain valve, particularly in the pipe leading to the shower spray head, drains into the chamber 7. From the chamber 7, the water may seep past the clack valve 3 through the clearance gap 9 into the port and be discharged to waste through the drain outlet 17.

When flow commences on showering, the pipe leading to the shower head fills and water flows into the chamber 7. Because of the restriction provided by the clearance gap 9, pressure will increase in the chamber 7 until it is sufficient to overcome the bias of spring 14 thereby to cause the clack valve to close on the seating 8.

Once the clack valve is closed, no discharge through the drain valve occurs whilst the shower is being used. On closing the appropriate control for the shower to stop the water flow, the pressure in the chamber 17 will fall until the spring bias is greater to move the clack valve into the open position in which the drain-off function is assumed automatically.

The simplicity of operation and automatic function without interference to the essential parts of the shower system or installation will be appreciated from the foregoing description.

It will also be understood that the form of the drain valve body may be designed to harmonise with the shower system and by suitable orientation of the drain outlet and/or the boss, the drained water could be directed towards a waste.

I claim:

1. In a shower system for ablutionary use having a water supply pipe leading to a shower head, a drain valve is fitted to communicate with the lowest point of said water supply pipe, said drain valve comprises a hollow body having a drain outlet and an inlet chamber opposed to said drain outlet with the inlet chamber in communication with said water supply pipe, a clack valve mounted in said inlet chamber for movement relative to a valve seat, an outlet port adjacent said valve seat and opening to said drain outlet, spring means acting on said clack valve to bias it into a first position disposed away from said valve seat and opening said outlet port, a restricted clearance between said clack valve and the wall of said inlet chamber permitting water in said chamber to seep past said clack valve through said port to said drain outlet when the pressure in said inlet chember is less than the spring bias pressure, and said clack valve being movable to a second position closing on said valve seat when the pressure in said inlet chamber and said water supply pipe overcomes said spring bias pressure.

2. A system according to claim 1 wherein said valve body comprises a substantially cylindrical body with said clack valve being mounted on a spindle for axial movement between said first and second positions, the spindle being supported concentric to said valve seat.

3. A system according to claim 2 wherein said clack valve is of annular form mounted on the head of said spindle with said restricted clearance being an annular gap between the periphery of said clack valve and a cylindrical inner wall of said valve body.

4. A system according to claim 3 wherein said valve seat, said outlet port and the spindle support are provided by a seat member located within said valve body remote from said inlet chamber.

5. A system according to claim 4 wherein said seat member comprises a central closed bore in which said spindle is supported with a helical coil spring acting between said seat member and said spindle.

6. A system according to claim 5 wherein one end of said spring is received in a closed end bore extending axially within said spindle.

7. A system according to claim 6 wherein said seat member mounts an adjuster of which one end extends into the central closed end bore of said seat member and engages the other end of said spring, said adjuster being movable with respect to said seat member to vary said spring pressure bias applied by said spring to said clack valve.

8. A system according to claim 1 wherein said water supply pipe is a rising supply pipe connected to said shower head and including a water control valve, said drain valve being fitted to said supply pipe to drain down water in said rising supply pipe when said control valve is closed.

* * * * *